US008794170B2

(12) United States Patent
Eppen et al.

(10) Patent No.: US 8,794,170 B2
(45) Date of Patent: Aug. 5, 2014

(54) DEVICE FOR ANCHORING A BOAT

(76) Inventors: Ralph Eppen, South Saint Paul, MN (US); Donald R. Rowan, Hastings, MN (US)

( * ) Notice: Subject to any disclaimer, the term of this patent is extended or adjusted under 35 U.S.C. 154(b) by 0 days.

(21) Appl. No.: 13/342,932

(22) Filed: Jan. 3, 2012

(65) Prior Publication Data

US 2013/0167765 A1 Jul. 4, 2013

(51) Int. Cl.
*B63B 21/00* (2006.01)

(52) U.S. Cl.
USPC ..... 114/230.26; 114/230.25; 114/230.24

(58) Field of Classification Search
USPC ..... 114/230.26, 230.2, 230.25
See application file for complete search history.

(56) References Cited

U.S. PATENT DOCUMENTS

| | | | | |
|---|---|---|---|---|
| 4,864,956 | A * | 9/1989 | Onstwedder, Jr. | 114/230.24 |
| 5,168,823 | A * | 12/1992 | Sheppard, Jr. | 114/230.26 |
| 6,273,017 | B1 * | 8/2001 | Griffin | 114/230.25 |
| 6,357,378 | B1 * | 3/2002 | Hile | 114/230.2 |
| 6,439,149 | B1 * | 8/2002 | Hile | 114/294 |
| D509,785 | S * | 9/2005 | Darling et al. | D12/317 |
| 6,983,714 | B2 * | 1/2006 | Dove et al. | 114/293 |
| 7,516,713 | B1 * | 4/2009 | Franta | 114/293 |
| 7,651,299 | B2 * | 1/2010 | Huang | 405/224 |
| 7,690,319 | B2 * | 4/2010 | Wingate | 114/230.23 |
| 2011/0146558 | A1 * | 6/2011 | Korell et al. | 114/230.26 |
| 2013/0167765 | A1 * | 7/2013 | Eppen et al. | 114/230.26 |

* cited by examiner

*Primary Examiner* — Lars A Olson
*Assistant Examiner* — Jovon Hayes
(74) *Attorney, Agent, or Firm* — Lyman H. Smith

(57) ABSTRACT

A device for anchoring a boat includes a multi part anchor line adapted to attach to the boat; a lead line having a first end and a second end; a first hook attached to the first end of the lead line adapted to releasably attach to a bow eye of the boat; and a second hook attached to the second end of the lead line adapted releasably attach to the anchor line. The anchor line and lead line cooperate to anchor the boat.

2 Claims, 2 Drawing Sheets

DEVICE FOR ANCHORING A BOAT

BACKGROUND OF THE INVENTION

I. Field of the Invention

This invention relates generally to small watercraft and more particularly to an improved anchoring arrangement for such watercraft.

II. Discussion of the Prior Art

It is well established that in anchoring a small boat that the rope length between the boat and anchor should be five feet for each foot of depth and that the anchor rope be secured as low as possible on the boat, such as on the bow eye. However, to clip an anchor rope to the bow eye when the boat is afloat in choppy waters exposes the operator to a risk of falling overboard.

SUMMARY OF THE INVENTION

The present invention provides an improved anchoring device for a boat having a bow eye that comprises a multi-segment anchor line adapted for being coupled to the bow eye of the boat by a lead line having a hook attached to a first end of the lead line for releasable attachment to the bow eye, the lead line having a second hook at a second end thereof for releasable attachment to one end of the anchor line. The lead line is dimensioned to allow it to be connected at one end to the bow eye and loop back through a loop at a proximal end of the anchor line so the second end of the lead line attaches by a releasable connection to a boat cleat safely accessible by a person riding in the boat.

DESCRIPTION OF THE DRAWINGS

The foregoing features, objects and advantage of the invention will become apparent to those skilled in the art from the following detailed description of a preferred embodiment, especially when considered in conjunction with the accompanying drawings in which like numerals in the several views refer to corresponding parts.

DETAILED DESCRIPTION OF THE INVENTION

Figure 1:
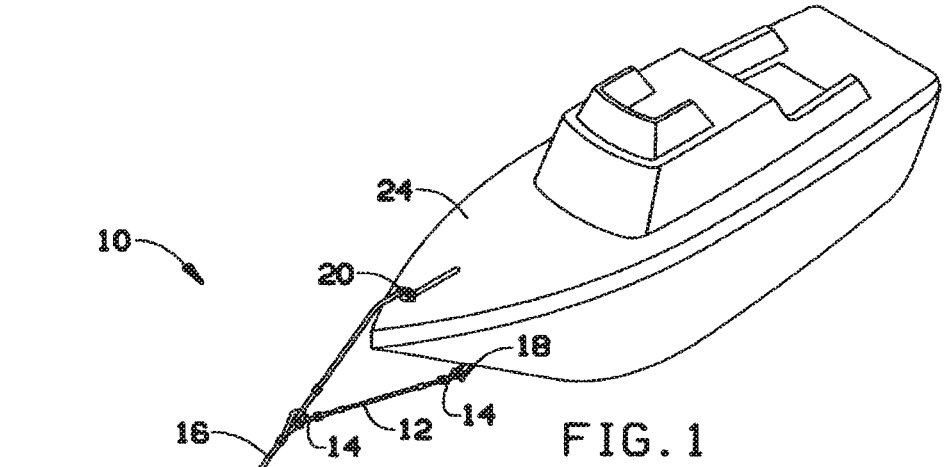
FIG. 1 is a perspective view of the embodiment of the present invention.
Figure 2:
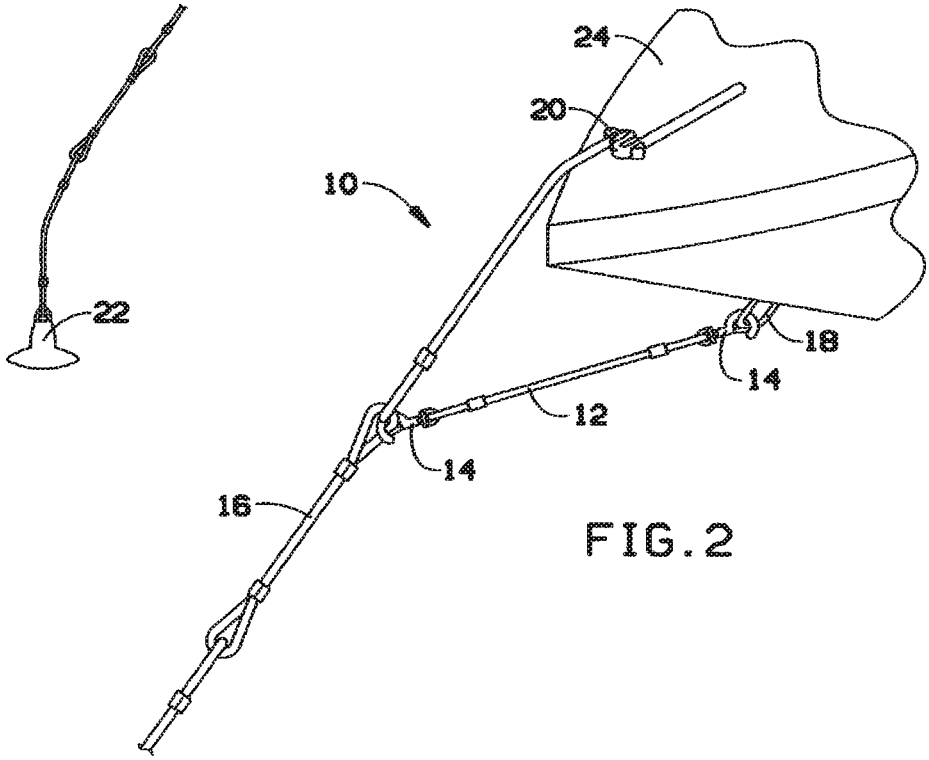
FIG. 2 is an enlarged detail perspective view of an embodiment of the present invention.
Figure 3:
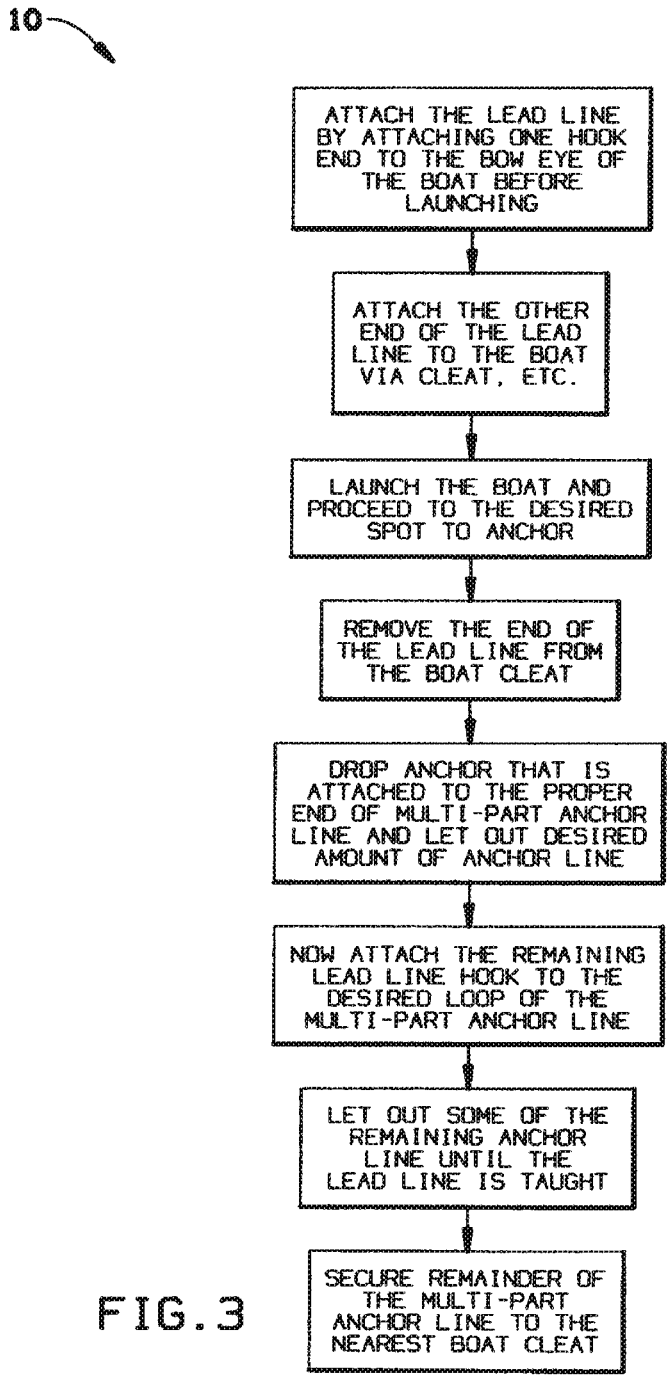
FIG. 3 is a flow chart of an embodiment of the invention.

The foregoing detailed description is of the best currently contemplated modes of carrying out exemplary embodiments of the invention. The description is not to be taken in a limiting sense but is made merely for the purpose of illustrating the general principles of the invention since the scope of the invention is best defined by the appended claims.

Broadly, an embodiment of the present invention generally provides a means of attaching an anchor rope to the bow eye of a boat (the preferred and most efficient position to attach an anchor rope to a boat) without having to risk falling overboard by eliminating having to lean out over the bow of the boat to attach the anchor rope to the bow eye.

Attaching and adjusting an anchor rope to the bow eye in accordance with the prior art may require leaning out and over the boat, which can result in injury and death by drowning, hypothermia, etc.

In an embodiment of the present invention, an anchor rope is attached to the boat's bow eye. This may reduce side-to-side motion in heavy waves that occurs when the anchor is attached to a boat cleat at the top of the gunnel and of the center of the boat. It is also attached at the lowest point possible on the boat, allowing the boat to ride over waves better and reduce risk of the bow plowing through waves taking unwanted water into the boat over the bow and increasing the chance of sinking the boat.

An embodiment of the present invention relates to a device 10 for attaching an anchor rope to a bow eye 18 of a boat 24. This may be the preferred and most efficient position to attach an anchor rope to a boat. This may avoid having to risk falling overboard by eliminating the need to lean out over the bow of the boat to attach the anchor rope to the bow eye.

In an embodiment, as depicted in the figures, the first component is named a lead line and is referenced 12. The second component is named a hook and is referenced 14. The third component is named a multi part anchor line and is referenced 16.

In an embodiment, lead line 12 preferably (but not necessarily) between 2 and 10 feet in length, longer if desired and is more preferably about 6 feet in length. Lead line 12 is preferably (but not necessarily) made of wire, cotton, polyester, hemp, synthetic material or nylon material strap or rope and is more preferably made of solid core braided nylon rope. The diameter of lead line 12 is preferably (but not necessarily) between $1/4^{th}$ and 3 inches in diameter and is more preferably $3/8^{ths}$ or ½ inch in diameter. If lead line 12 is made of a strap, the width is preferably (but not necessarily) $1/4^{th}$ to 3 inches in width and is more preferably about 1 inch in width. Hook 14 is made of metal or plastic and is preferably (but not necessarily) made of non-corrosive plastic or metal and is more preferably made of brass with a snap swivel clip. Anchor line 16 is preferably (but not necessarily) between 50 and 500 feet or more in length and is more preferably a length of about 5 feet for every foot of water the anchor is set in and is more commonly of 100 feet to 200 feet in length. Anchor line 16 is preferably (but not necessarily) made of wire, cotton, polyester, hemp, synthetic or nylon material strap or rope and is more preferably made of solid core braided nylon rope. The diameter of anchor line 16 is preferably (but not necessarily) between $1/4^{th}$ and 3 inches in diameter and is more preferably about $3/8^{ths}$ or ½ inch in diameter. If anchor line 16 is made of a strap, the width is preferably (but not necessarily) between about $1/4^{th}$ and 3 inches wide and is more preferably about 1 inch in width.

An embodiment includes lead line 12 and hook 14 to attach anchor line 16 safely to the bow eye of the boat. A float may be attached to lead line 12 to prevent loss if it became unattached from the bow eye and anchor line 16. The completed system may be used by hand and is compatible for use on mechanical and power type anchor deployment and retrieval products.

In an embodiment, lead line 12 is connected preferably (but not necessarily) by a knot, splice or loop to hook 14 and is more preferably connected by a loop to each end of lead line 12. One hook 14 is connected to the bow eye and the other to a loop in anchor line 16.

In an embodiment, one end of lead line 12 is attached to the bow eye of the boat with hook 14 before launching the boat. The other end is attached to a boat cleat preferably (but not necessarily) a boat cleat 20 at the front of the boat for safe travel till reaching the destination where the anchor attached to anchor line 16 is deployed. Once the anchor is deployed to desired depth and any length desired (preferably but not necessarily) about 5 feet of anchor line 16 for each foot of water. Remove lead line 12 from boat cleat 20 and attach it to anchor line 16 with hook 14 at the desired loop in anchor line 16. Let out anchor line 16 till lead line 12 is taut. Secure remaining line from anchor line 16 to the boat cleat for safety and loss prevention of anchor line 16 in case hook 14 came loose from anchor line 16 or the bow eye of the boat. The completed system may be used by hand or also may be used with mechanical and power anchor retrieval products.

In an embodiment, to construct lead line 12, take a piece of rope about 8 feet, insert rope into an aluminum oval swage crimp sleeve of appropriate size to a point of about 12 inches up the rope. Insert tag end of the rope through the ringed connector of hook 14. Insert tag end of rope into sleeve to fit just past flush of the sleeve. Crimp sleeve to secure, thus forming a loop of about 6 inches with hook 14 now attached to the loop. Proceed with other end of rope in the same manner to connect another hook 14. Construction of lead line 12 has now been completed. To construct anchor line 16, take a piece of rope of about 11 feet in length. One end stays straight with no loop. The other end of the rope is inserted into an aluminum oval swage crimp sleeve of appropriate size about 12 inches up the rope. Insert tag end of the rope just past flush. Crimp sleeve to secure, thus forming a loop of about 6 inches and is now completed. The remaining length of anchor line 16 is made up of lengths of rope about 22 feet long. Take a piece of 22 foot long rope and insert one tag end through an aluminum oval swage sleeve, slide up the rope to about 1 foot. Insert same tag end into the loop just made on the 11 foot rope. Take the same tag end and insert into the sleeve just past flush and crimp sleeve. Take the other end of the 22 foot piece of rope, insert into an aluminum oval swage sleeve sliding the sleeve up the rope about 12 inches. Take tag end and insert into the sleeve just past flush and crimp sleeve. Take another 22 foot piece of rope and insert into an aluminum oval swage sleeve sliding the sleeve up about 12 inches. Insert tag end through the loop of the prior 22 foot piece of rope. Take tag end and insert into the sleeve jut past flush. Crimp the sleeve. Continue attaching sections of 22 feet of rope until the total desired length of anchor line 16 is achieved. The last loop in the rope is used to attach an anchor of any type desired. Anchor line 16 is now completed.

In another embodiment, instead of permanently attaching each link of anchor line 16 as described in how to make this invention, one may make each link separately. Attach loops for example by inserting a loop assembly of a 22 foot section and insert through the loop of the 11 foot section. Next take the straight section of the 11 foot section and insert through the loop of the 22 foot section, thus making a secure connection that can later be removed easily by reversing the previous steps. Additional 22 foot sections of the rope may be attached in the same manner till the total desirable length is reached. If connected in this manner, a more modular length of anchor line 16 is made and different configurations of length can be achieved without having to cut and re-splice the rope.

Step one is to attach lead line 12 to the boat by attaching one hook 14 to the bow eye of the boat before launching. Step 2 is to attach the other end of the lead line 12 to a nearby boat cleat 20 attached to the boat. Launch boat and proceed to the desired spot to anchor. Remove the end of lead line 12 from the boat cleat. Drop anchor that is attached to the proper end of anchor line 16 and let out desired amount of anchor line 16. Now attach the remaining hook 14 to the desired loop of anchor line 16. Let out some of the remaining anchor line 16 till hook 14 is taut. Secure remainder of anchor line 16 to the nearest boat cleat 20. To obtain the maximum holding of the anchor, it should be of the proper size for the boat. The recommended amount of anchor line 16 is five feet of rope for each foot of water the boat is being anchored in for maximum effect.

Lead line 12 may be used for securing the boat at dockside. Lead line 12 may be connected to a drift sock or sea anchor device with hook 14 and safety line from drift sock or sea anchor device to desired boat cleat in the same manner as anchor line 16.

Existing anchor systems do not attach to the bow eye of the boat prior to launching of the boat for safe travel and deployment of an adjustable anchor rope connected to the bow eye.

It should be understood, of course, that the foregoing relates to exemplary embodiments of the invention and that modifications may be made without departing from the spirit and scope of the invention as set forth in the following claims.

The invention claimed is:

1. A device for anchoring a boat, comprising:

a multi part anchor line formed from a plurality of sections having a loop at each end thereof, each of the plurality of sections being directly connected to an adjacent one of the plurality of sections, the multi part anchor line forming a direct connection, via the plurality of sections, between the boat and an anchor;

a lead line having a first end and a second end;

a first hook attached to the first end of the lead line, the first hook attached to a bow eye of the boat when the device is operated to anchor the boat; and a second hook attached to the second end of the lead line, the second hook releasably attached to one of the loops disposed along a span of the anchor line when the device is operated to anchor a boat;

wherein, when the anchor is used to anchor the boat, the anchor line secures the boat via a taut lead line and the anchor line, thus effectively anchoring the boat from the bow eye without having to directly attach the anchor line to the bow eye.

2. An anchor system for a boat, comprising:

a continuous anchor line extending from the boat to an anchor, the anchor line formed from a plurality of sections have a loop on each end thereof, each of the plurality of sections being directly connected to an adjacent one of the plurality of sections, the multi part anchor line forming a direct connection, via the plurality of sections, between the boat and an anchor;

a lead line having a first end attached to a bow eye of the boat and a second end removably attached to one of the loops along a span of the anchor line after deployment of the anchor, wherein the lead line and the anchor line are used to anchor the boat from the bow eye.

* * * * *